US005217359A

United States Patent [19]

Kawahara et al.

[11] Patent Number: 5,217,359

[45] Date of Patent: Jun. 8, 1993

[54] SCROLL COMPRESSOR WITH REGULATED OIL FLOW TO THE BACK PRESSURE CHAMBER

[75] Inventors: Sadao Kawahara, Otsu; Michio Yamamura, Kusatsu; Jiro Yuda, Ikoma; Yoshinori Kojima, Kusatsu; Shuichi Yamamoto, Otsu; Manabu Sakai, Toyonaka; Shigeru Muramatsu; Osamu Aiba, both of Kusatsu, all of Japan

[73] Assignee: Matsushita Electric Industrial Co., Ltd., Osaka, Japan

[21] Appl. No.: 720,483

[22] Filed: Sep. 3, 1991

[30] Foreign Application Priority Data

Nov. 2, 1989 [JP] Japan ..... 1-287018

[51] Int. Cl.[5] ..... F04C 18/04; F04C 29/02

[52] U.S. Cl. ..... 418/55.4; 418/55.5; 418/55.6; 418/99

[58] Field of Search ..... 418/55.4, 55.5, 55.6, 418/99, 100, 57

[56] References Cited

U.S. PATENT DOCUMENTS 4,743,181 5/1988 Murayama et al. ..... 418/55.4

FOREIGN PATENT DOCUMENTS 58-110885 7/1983 Japan .
59-93987 5/1984 Japan .
59-194589 12/1984 Japan .
60-93192 5/1985 Japan ..... 418/55.6
61-265302 11/1986 Japan .
62-10487 1/1987 Japan .
62-178791 8/1987 Japan .
63-106387 5/1988 Japan .
63-134187 9/1988 Japan .
01-177482 1/1989 Japan .
01-177481 7/1989 Japan .

*Primary Examiner*—John J. Vrablik
*Attorney, Agent, or Firm*—Stevens, Davis, Miller & Mosher

[57] ABSTRACT

A compressor includes a communication hole 42 through which lubrication oil in an oil reservoir 5 is supplied to a back pressure chamber 39 at least through an eccentrically driving bearing 15, and a communication bore 45 or gap through which the lubrication oil in the back pressure chamber 39 is fed into compression spaces, and a constricted resistance member 44 for regulating the oil flow rate is provided on the communication hole 42. The passage resistance can be made larger in comparison with the case where resistance is caused in a small space of a sliding portion of a bearing, and an accurate value of the passage resistance can be preset with the oil flow rate being low, thereby preventing flow of the lubrication oil to the compression operating spaces from increasing in quantity. Thus, there is provided a highly reliable scroll compressor which has a high compression efficiency, consumes power constantly, and has no risk of compression of the lubrication oil in the compression operating spaces.

3 Claims, 4 Drawing Sheets

SCROLL COMPRESSOR WITH REGULATED OIL FLOW TO THE BACK PRESSURE CHAMBER

TECHNICAL FIELD

The present invention relates to a scroll-type compressor.

BACKGROUND ART

FIG. 1 is a vertical cross-sectional view of a conventional electric motor driven scroll compressor which is disclosed as a "scroll compressor" in Japanese Patent Unexamined Publication No. 1-177481. The scroll compressor comprises: a compression unit 102 and a motor 103 mounted on the unit, the compression unit and the motor being provided inside of a sealed vessel 101; a body frame 105 of the compression unit 102 which frame sustains a driving shaft 104 driven by the motor 103; and a discharge chamber oil reservoir 106 provided between the body frame 105 and the motor 103. Oil in the discharge chamber oil reservoir 106 provided between the motor 103 and the body frame 105 is delivered to an annular groove 108 via an oil hole 107 formed in the body frame 105, and it is also supplied from the oil hole 107 to an eccentric bearing space 114 through a small gap of a sliding portion of a main rod bearing 109 and through an oil groove 113 formed in an eccentric bearing 112 for a swinging shaft 111 of a swinging scroll 110 provided on an end portion of the driving shaft 104. While the oil is passed through the small space of the sliding portion of the main rod bearing 109, its pressure is reduced to have a value of an intermediate pressure between the discharge pressure and the suction pressure. The oil in the eccentric bearing space 114 enters into an outer peripheral portion space 116 through an oil hole 115 formed in the swinging scroll 110, passes an oil hole 117 which is opened intermittently on the side of the swinging scroll 110, an injection groove 118 and two injection openings 119 having a small diameter, and flows into a compression chamber 120. As a result, it is the above-mentioned intermediate pressure which has been reduced in the small space of the sliding portion of the main rod bearing 109 that serves as a force to press the swinging scroll 110 against a fixed scroll 121.

However, the small space of the sliding portion has a large dispersion of manufacturing errors which makes it difficult to regulate the intermediate pressure with accuracy and induces a large fluctuation of the flow rate of the oil, so that the efficiency of the compressor may be affected by an amount of the oil which flows into the compression chamber 120. Besides, if a large amount of the oil flows into it, there is a risk that the compression chamber 120 may be broken by oil compression.

DISCLOSURE OF THE INVENTION

The present invention has an object to enable highly precise regulation of the oil flow rate which has been the subject of the conventional scroll compressor described above, thereby improving the efficiency and reliability of a compressor and achieving the object with a simple structure.

More specifically, the scroll compressor has a compression mechanism driven by a motor or other driving mechanism, wherein the compression mechanism comprises: a fixed volute vane member including a fixed volute vane which is formed on a fixed frame; a swinging volute vane member including a swinging end plate on which a swinging volute vane is fixed or formed to be engaged with the fixed volute vane to define a plurality of compressing operation spaces; a rotation restricting member which prevents the swinging volute vane member from rotating itself and allows it to swing only; a crankshaft for driving the volute vane member to swing by power of the motor or other driving mechanism; a bearing member including a main rod bearing which sustains a main rod of the crank shaft; the discharge-side pressure of the compression mechanism being exerted on an oil reservoir in which lubrication oil supplied to the main rod bearing is stored; a back pressure chamber, on which a fluid pressure equal to or larger than a pressure on the suction side of the compression mechanism and smaller than the discharge-side pressure is exerted, formed on the back surface of the swinging end plate on the other side of which the swinging volute vane is provided; a swinging driven shaft or a swinging driven bearing formed on the swinging end plate back surface; an eccentrically driving bearing or an eccentrically driving shaft of the crank shaft engaged with the swinging driven shaft or the swinging driven bearing; a sliding seal ring provided between the swinging end plate back surface and the bearing member so as to slide and serve as a partition between a space surrounding the swinging driven shaft or the swinging driven bearing on which space the discharge pressure is exerted by the lubrication oil of the oil reservoir and the back pressure chamber in the outer peripheral direction; a communication hole through which the lubrication oil of the oil reservoir is supplied at least from the space to the back pressure chamber through the eccentrically driving bearing and a communication bore or gap through which the oil of the back pressure chamber is fed into the compression operating spaces; and a constricted resistance member provided on the communication hole for regulating the oil flow rate.

BEST MODE FOR CARRYING OUT THE INVENTION

Figure 2:
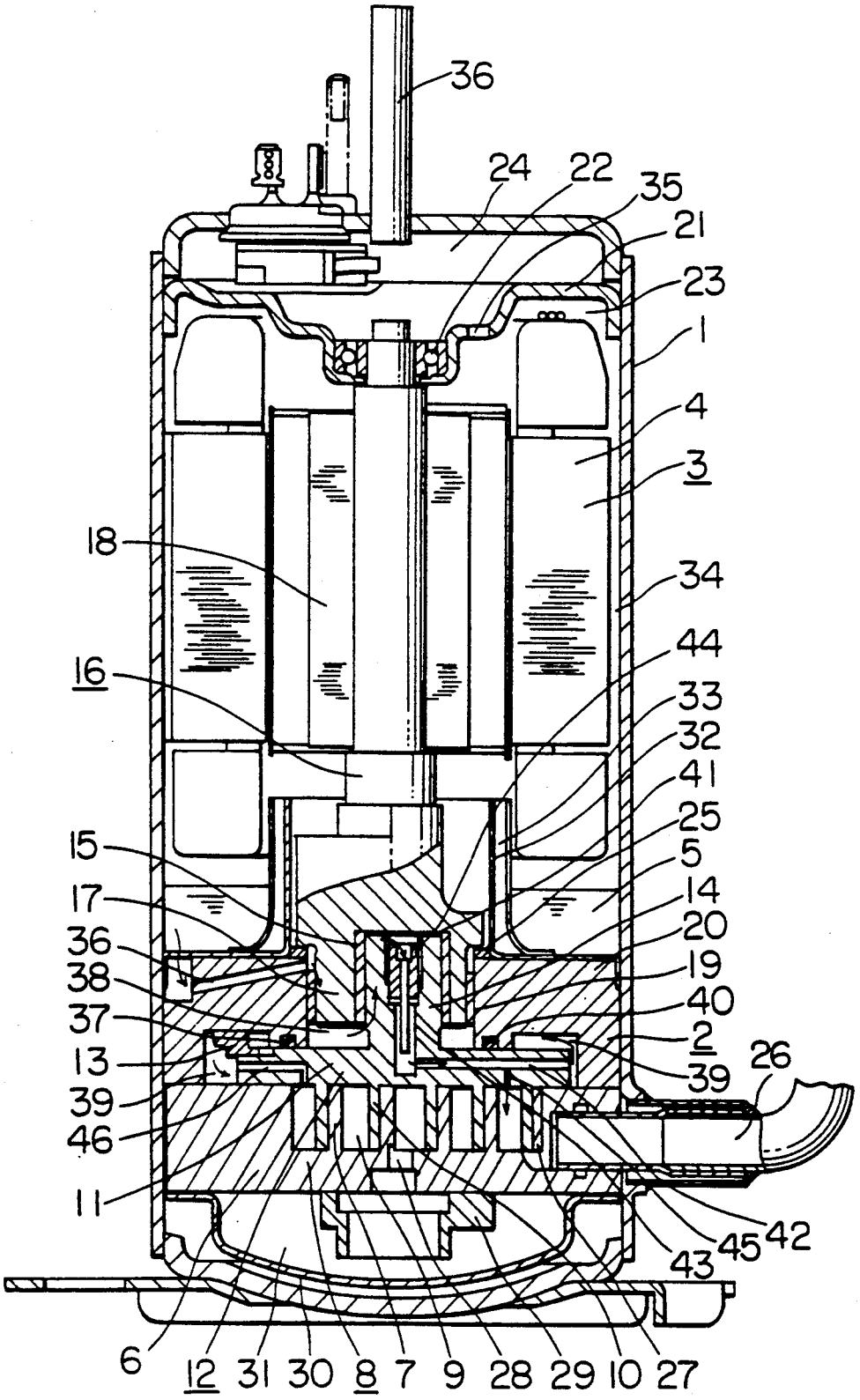
FIG. 2 is a cross-sectional view of a scroll compressor according to one embodiment of the present invention.
Figure 3:
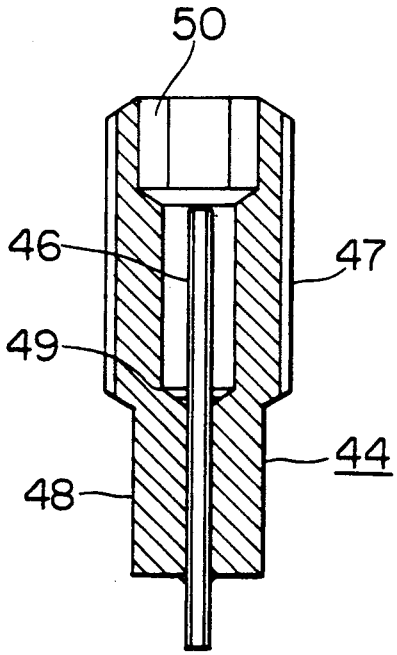
FIG. 3 is a specific cross-sectional view of an essential portion of the same compressor.

FIG. 2 illustrates one embodiment of a scroll compressor according to the present invention. A compression mechanism 2 and a stator 4 of a motor 3 for driving it are fixed at the inside of a sealed vessel 1, and a lubrication oil reservoir 5 is provided below the motor 3. The compression mechanism 2 comprises: a fixed volute vane member 8 including a fixed volute vane 7 which is integrally formed on a fixed frame 6; a swinging volute vane member 12 including a swinging end plate 11 on which a swinging volute vane 10 is formed to be engaged with the fixed volute vane 7 to define a plurality of compressing operation spaces 9; a rotation restricting member 13 which prevents the swinging volute vane member 12 from rotating itself and allows it to swing only; a crank shaft 16, which includes an eccentrically driving bearing 15, for driving a swinging driven shaft 14 provided on the back surface of the swinging end plate 11 to swing eccentrically; a bearing member 20 including a main rod bearing 19 which sustains a main rod 17 of the crank shaft 16 below a rotor 18 of the motor 3; and the like. The upper end of the crank shaft 16 is extended through a ball bearing 22 secured on a partition wall 21, and the partition wall 21 divides a space above the stator 4 and the rotor 18 of the motor into a motor-side space 23 and a discharge chamber 24. The bearing member 20 is provided with a thrust bearing 25 which receives an axial-direction load of the crank shaft 16. Coolant gas is sucked from a suction pipe 26 into a suction chamber 27 of the compression mechanism 2 including the fixed volute vane member 8 and the swinging volute vane member 12. After being compressed in the compression operating spaces 9, the coolant gas is discharged from a discharge opening 28 formed in the fixed volute vane member 8 via a discharge guide 29 into a discharge space 31 surrounded by a discharge muffler. From this discharge space 31, the coolant gas is delivered through a communication hole (not shown) extending through the fixed volute vane member 8 and the bearing member 20, flows upwardly through a passage 33 of a housing 32 of the crank shaft, is introduced, via a communication passage 34 provided on the periphery of the stator 4 of the motor 3, into the motor-side space 23 above the stator 4, passes through a passage hole 35 into the discharge chamber 24, and is discharged from a discharge pipe 36 to the outside of the compressor. With this structure, the pressure on the discharge side is exerted on the oil reservoir 5 where the lubrication oil is stored. Next, the structure of lubrication for the compression mechanism will be described. Lubrication oil in the oil reservoir 5 is supplied via an oil supply hole 36 formed in the bearing member 20 to the main rod bearing 19, which sustains the main rod 17 of the crank shaft 16, as indicated by arrows. The swinging driven shaft 14, which is engaged in the eccentrically driving bearing 15 of the crank shaft 16, is formed substantially in the center of the swinging end plate back surface 37 of the swinging end plate 11, and a sliding seal ring 40 is provided between the swinging end plate back surface 37 and the bearing member 20 so as to slide and divide a space therebetween into a peripheral space 38 surrounding the swinging driven shaft 14 and a back pressure chamber 39 provided on the outer periphery of the swinging end plate 11. The lubrication oil which has lubricated the main rod bearing 19 flows into the above-mentioned peripheral space 38, lubricates the eccentrically driving bearing 15, and reaches an end-portion space 41 of the swinging shaft 14. A communication hole 42 is provided for communicating the end-portion space 41 with the central portion of the swinging driven shaft 14 along the axial direction and further communicating the swinging end plate 11 with the back pressure chamber 39 along the radial direction, and also, a constricted resistance member 44 for regulating an oil flow rate is provided in a hole section 43 of the communication hole 42 extending along the axial direction of the swinging driven shaft 14. The communication hole 42 is formed with a communication bore 45 for supplying the lubrication oil to the compression operating space 9 and with a communication bore 46 for supplying the lubrication oil in the back pressure chamber 39 to the compression operating space 9 on the other side. The pressure in the above-mentioned peripheral space 38 is slightly lower than the discharge coolant pressure due to flow resistance of the lubrication oil when it passes the main rod bearing 15, but it becomes almost the same as this discharge pressure. The pressure of the lubrication oil in the back pressure chamber 39 is determined by the average pressure of the compression operating spaces 9 or the passage resistances of the constricted resistance member 44 and the communication bore 46 because the constricted resistance member 44 applies flow resistance to the lubrication oil and regulates its flow rate while the back pressure chamber is communicated with the compression operating spaces 9 by the communication bore 46. The pressure of the lubrication oil in the back pressure chamber is made smaller than that of the lubrication oil in the peripheral space 38, and becomes a fluid pressure which is equal to or larger than the pressure on the suction side of the compression mechanism and smaller than the pressure in the peripheral space 38. The resistance of the communication bore 46 is preset to be smaller than that of the constricted resistance member 44. In this manner, the flow rate of the lubrication oil is regulated by the constricted resistance member 44, so that the passage resistance can be made larger in comparison with the case where resistance is caused in a slight space of a sliding portion of the bearing, and that an accurate value of the passage resistance can be preset with the oil flow rate being low, thereby preventing supply of the lubrication oil to the compression operating spaces 9 from increasing in quantity. FIG. 3 specifically illustrates one embodiment of the constricted resistance member used in the one embodiment of the present invention shown in FIG. 2. The constricted resistance member 44 comprises a thin tube 46 made of a material such as stainless steel and copper and a member 48 with a thread portion 47 to be screw-fastened on the communication hole 42. This member 48 and the thin tube 46 are soldered by a solder material 49, and the member 48 is formed with a hexagon socket 50 for tightly screwing the member to the communication hole 42 by means of a hexagon wrench (not shown). The lubrication oil is reduced in pressure while it flows through the thin tube 46 so as to regulate its flow rate. This thin tube 26 can be arranged to have a highly precise value of resistance when a drawn tube is used for it.

Figure 1:
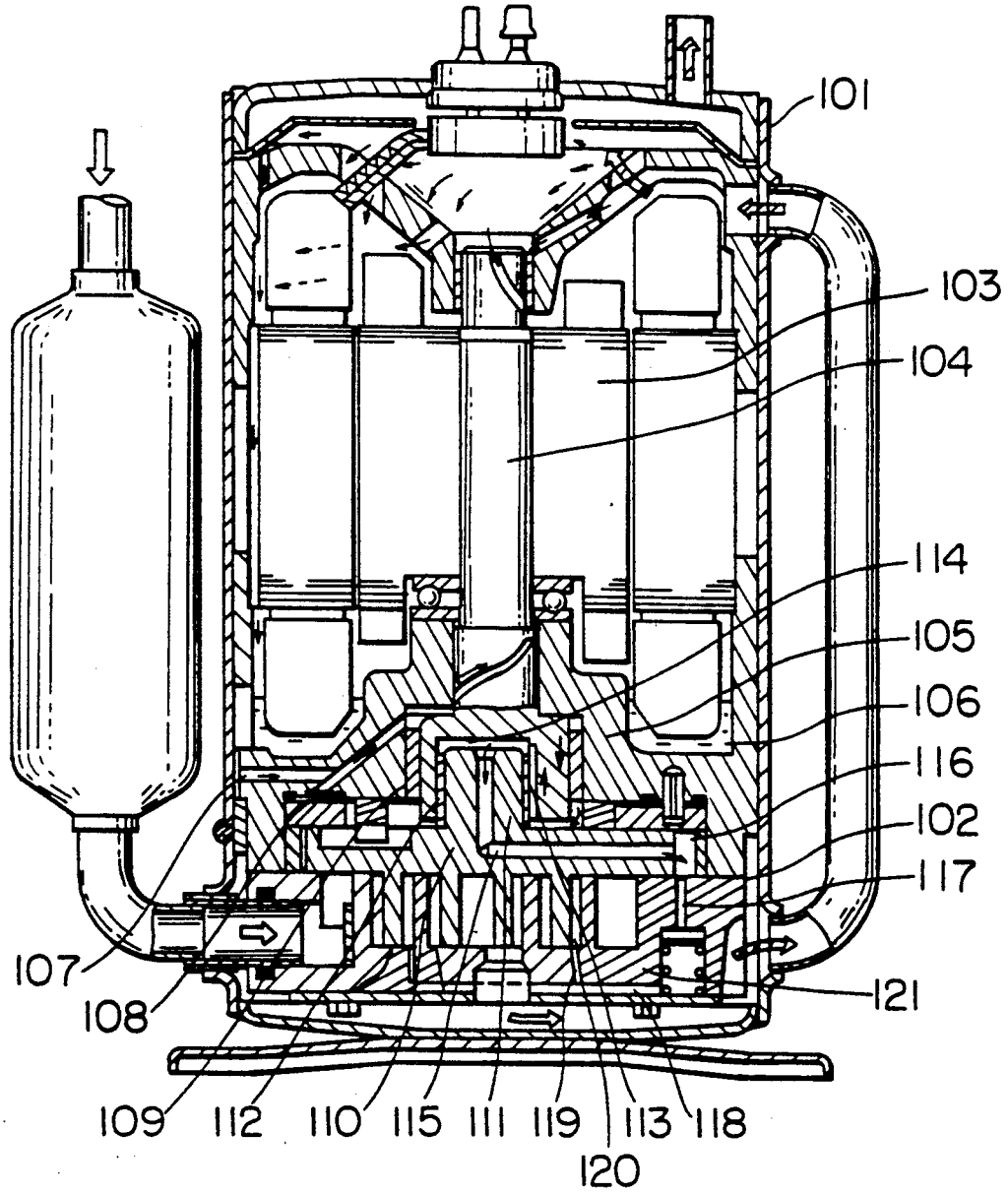
FIG. 1 PRIOR ART
FIG. 1 is a cross-sectional view of a conventional scroll compressor.
Figure 4:
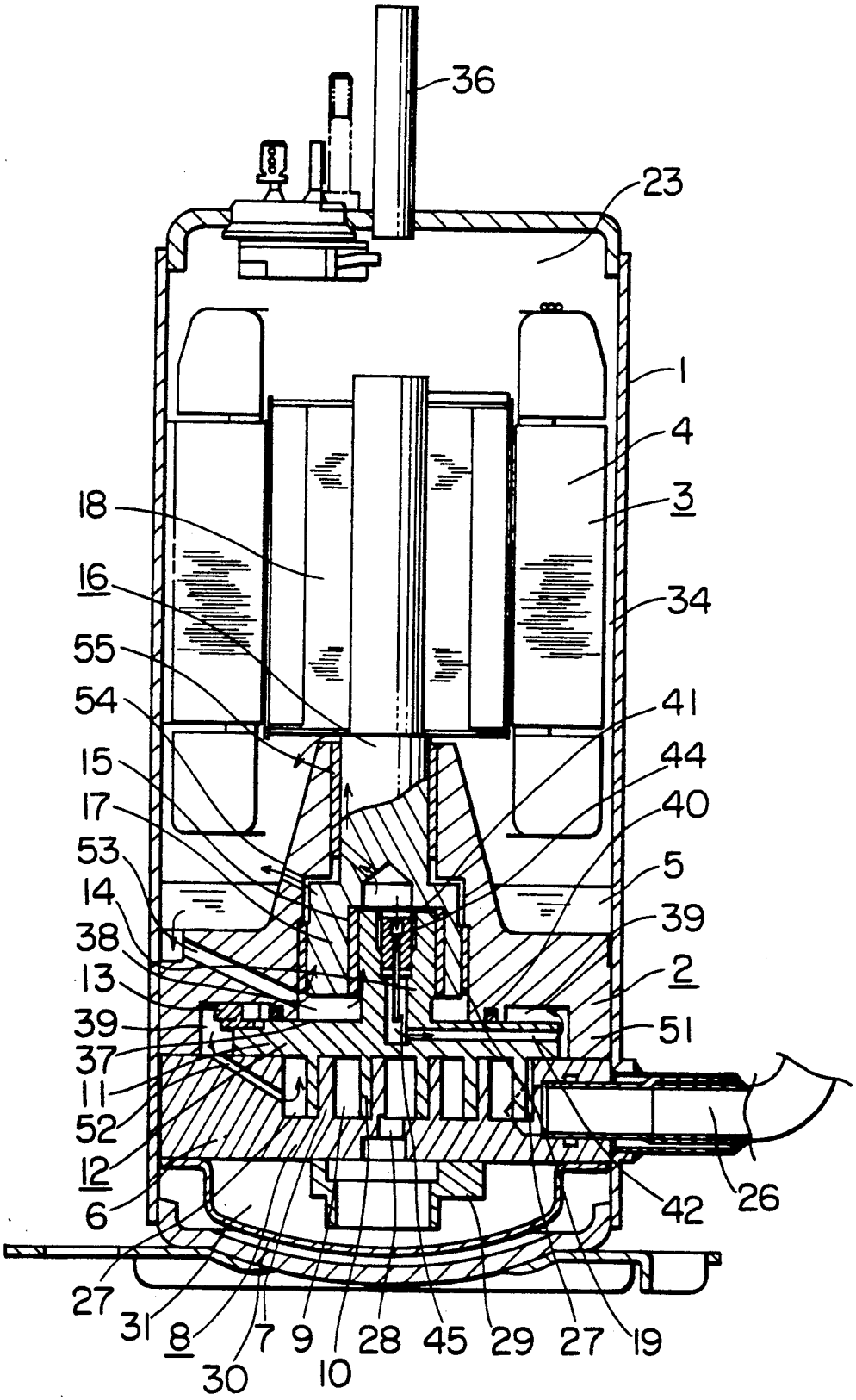
FIG. 4 is a cross-sectional view of a scroll compressor according to another embodiment of the present invention.

FIG. 4 illustrates another embodiment of the present invention. Component parts denoted by the same reference numerals as in FIG. 1 have the same functions, whereas the structure of this embodiment is different in that the crank shaft 16 on which the rotor 18 is fixed is cantilever-supported by a bearing member 51, and that the lubrication oil in the back pressure chamber 39 shown in FIG. 2 is introduced through a communication bore 52 to a location in the compression operating spaces 9 to communicate with the suction chamber 27 in the compression mechanism 2 consisting of the fixed volute vane member 8 and the swinging volute vane member 12 so that the pressure in the back pressure chamber 39 becomes a low gas pressure. The swinging driven shaft 14 which is engaged in the eccentrically driving bearing 15 of the crank shaft 16 is formed substantially in the center of the swinging end plate back surface 37 of the swinging end plate 11, and the peripheral space 38 surrounding the swinging driven shaft 14 and the oil reservoir 5 are connected by an oil supply hole 53 formed in the bearing member 51. The lubrication oil in the peripheral space 38 is divided into two flows, and one of them lubricates the main rod bearing 19 and flows through a hole 54 to the oil reservoir 5, whereas the other is supplied to the eccentrically driving bearing 15, reaches the end-portion space 41, and is further divided into two flows. One of them lubricates a secondary bearing 55 provided on the bearing member 51 and located closer to the rotor 18 than the main rod bearing 19 is, and returns to the oil reservoir 5. The other enters into the communication hole 42 in communication with the back pressure chamber 39. The communication hole 42 is provided with the constricted resistance member 44 in the same manner as the embodiment shown in FIG. 2. The lubrication oil in the back pressure chamber 39 is introduced through the communication bore 52 to the location in the compression operating spaces 9 to communicate with the suction chamber 27, and flows into the compression operating spaces 9 with the coolant in order to effect lubrication and sealing of sliding portions of the compression operating spaces 9. Although the communication bore 52 is formed in the fixed volute vane member 8, the same function and effect can be obtained by arranging the fixed volute vane member 8 and the swinging volute vane member 12 to have a gap therebetween. In the two embodiments of the present invention, the crank shaft is provided in the vertical direction. However, the same function and effect can be obtained by a compressor whose crank shaft is extended in the horizontal direction, i.e., a horizontal-type compressor, because the structure for lubrication is of a differential pressure oil supply type. Moreover, although the compressor driven by the motor is explained above by way of example, it may be an open-type compressor which is driven through a driving shaft by certain means at the outside of the sealed vessel. Furthermore, the swinging driven shaft is formed on the swinging end plate back surface, and the eccentrically driving bearing of the crank shaft is engaged with the swinging driven shaft. However, it can be done without deviating from the spirit of the invention that a swinging driven bearing is formed on the swinging end plate back surface, and that an eccentrically driving shaft is provided on a distal-end portion of the crank shaft so as to be engaged in the swinging driven bearing.

INDUSTRIAL APPLICABILITY

In respect of an effect produced by the first technical means of the present invention, there are provided the communication hole through which the lubrication oil in the oil reservoir is supplied to the back pressure chamber at least through the eccentrically driving bearing and the communication bore or gap through which the lubrication oil in the back pressure chamber is fed into the compression spaces, and that the constricted resistance member for regulating the oil flow rate is provided on the above-mentioned communication hole, so that the passage resistance can be made larger in comparison with the case where resistance is caused in the small space of the sliding portion of the bearing, and that an accurate value of the passage resistance can be preset with the oil flow rate being low, thereby preventing flow of the lubrication oil to the compression operating spaces from increasing in quantity. Thus, there can be provided a highly reliable scroll compressor which has a high compression efficiency, consumes power constantly, and has no risk of compression of the lubrication oil in the compression operating spaces.

The second technical means of the invention produce an effect, in addition to the above effect of the first technical means, that a large and highly precise value of the passage resistance can be preset because the constricted resistance member is simply constructed of the thin tube and the member for fastening the thin tube on the above-mentioned communication hole.

The third technical means of the invention produce an effect, in addition to the above effect of the second technical means, that the compressor can be reduced in size because the constricted resistance member is provided in the eccentrically driving shaft so that it is not necessary to provide an installation space of the constricted resistance member additionally.

We claim:

1. A scroll compressor, comprising:

a compression mechanism;

a driving means for driving said compression mechanism;

a fixed volute vane member including a fixed volute vane which is formed on a fixed frame;

a swinging volute vane member including a swinging end plate and a swinging volute vane fixed or formed on a front surface of said swinging end plate to be engaged with the fixed volute vane so as to define a plurality of compressing operation spaces;

a rotation restricting member which prevents the swinging volute vane member from rotating and allows said swinging volute vane member to swing only;

a crank shaft powered by said driving means for driving said volute vane member to swing;

a bearing member including a main rod bearing which sustains a main rod of said crank shaft;

an oil reservoir in which lubrication oil for said main rod bearing is stored;

means, cooperating with said compression mechanism, for exerting a discharge pressure from said compression mechanism on said oil reservoir;

a back pressure chamber formed on a back surface of said swinging end plate opposite to the front surface on which said swinging volute vane is provided;

a swinging driven shaft formed on said back surface of said swinging end plate;

an eccentrically driving bearing, said main rod of said crank shaft being engaged with said swinging driven shaft through said eccentrically driving bearing;

said back surface of said swinging end plate and said main rod defining a space therebetween, said discharge pressure being exerted on said space by the lubrication oil of said oil reservoir;

a sliding seal ring, provided between said back surface of swinging end plate and said bearing member, defining a partition between said space and said back pressure chamber at an outer peripheral location of said space;

a communication hole, in fluid communication with said space and said back pressure chamber and provided through said eccentrically driving bearing, for supplying the lubrication oil of said oil reservoir at least from said space to said back pressure chamber, and a communication bore or gap, in fluid communication with said back pressure chamber and said compression operation spaces, for feeding the oil of the back pressure chamber into said compression operation spaces;

and a constricted resistance member associated with said communication hole for regulating a flow rate of said lubrication oil, whereby a fluid pressure equal to or larger than a pressure on a suction side of said compression mechanism and smaller than said discharge pressure is exerted on said back pressure chamber.

2. A scroll compressor according to claim 1, wherein said constricted resistance member comprises a thin tube and a means for fastening the thin tube on said communication hole.

3. A scroll compressor according to claim 1, wherein said constricted resistance member is provided in said eccentrically driving shaft.

* * * * *